United States Patent [19]

Kaiser

[11] Patent Number: 4,895,384

[45] Date of Patent: Jan. 23, 1990

[54] TOY TANK

[76] Inventor: Patrick G. Kaiser, 4975 Cathy La., Highland, Mich. 48031

[21] Appl. No.: 272,246

[22] Filed: Nov. 16, 1988

[51] Int. Cl.[4] ..... B62D 55/00
[52] U.S. Cl. ..... 280/206; 272/115
[58] Field of Search ..... 280/206, 207; 180/9, 180/10; 305/17, 47; 272/115

[56] References Cited

U.S. PATENT DOCUMENTS 2,667,349 1/1954 Jacobson ..... 180/9 X
4,056,289 11/1977 Gilliland ..... 272/115

*Primary Examiner*—John A. Pekar
*Attorney, Agent, or Firm*—Robert G. Mentag

[57] ABSTRACT

A rollable toy tank including a flexible, tubular body, which is open at the transverse sides thereof, and which is adapted to be rolled forward on a supporting ground or water surface by a child crawling inside of the tubular body.

1 Claim, 3 Drawing Sheets

TOY TANK

BACKGROUND OF THE INVENTION

1. Technical Field

The field of art to which this invention pertains may be generally located in the class of devices relating to toys.

2. Background Information

Many children do not get enough exercise and their motor skills, coordination, and balance are not very well developed because they get a ride to and from school, and when they get home they sit around and watch television and do things of that nature. It is well known that crawling provides a child with more exercise than riding a bicycle or pulling a wagon. When a child is crawling, he is using his back, his arms, his legs, his chest, and every muscle in the body associated with the aforementioned body parts in order to provide the crawling action. Accordingly, a child in carrying out a crawling action develops his motor skills and muscular coordination considerably more than a bicycle or a skate board, or any other type of action toy.

SUMMARY OF THE INVENTION

It is an object of the present invention to provide a rollable toy tank which include a flexible, tubular body adapted to be rollably disposed on a supporting medium such as the ground or a water surface. The flexible tubular body comprises a closed loop-shaped band which is open on the transverse sides thereof. The toy tank is adapted to be rolled forward on a supporting medium by a combination forward and downward directed force exerted on the internal surface of one end of the tubular body by at least one person crawling inside of the tubular body. The outer surface of the tubular body is provided with transverse treads and in one embodiment the transverse treads are only disposed along each of the outer side portions of the outer surface of the tubular body.

The tubular body of the rollable toy tank may be formed from any suitable material as for example, from a single sheet of solid, buoyant, thermal foam plastic that is folded into a closed loop-shaped band, with the ends of the sheet fixed together. The tubular body of the toy tank may also be formed from a plurality of elongated, hollow members which are disposed in a side-by-side relationship to form a closed loop-shaped band, and with adjacent members being fixed together, and wherein said elongated, hollow members are formed from a buoyant, thermal foam plastic material. In a modified embodiment, the tubular body may be formed from a corrugated material with an outer and inner coating of flexible plastic material. The corrugated material may be a suitable corrugated cardboard or corrugated plastic material.

DESCRIPTION OF THE PREFERRED EMBODIMENTS

Figure 1:
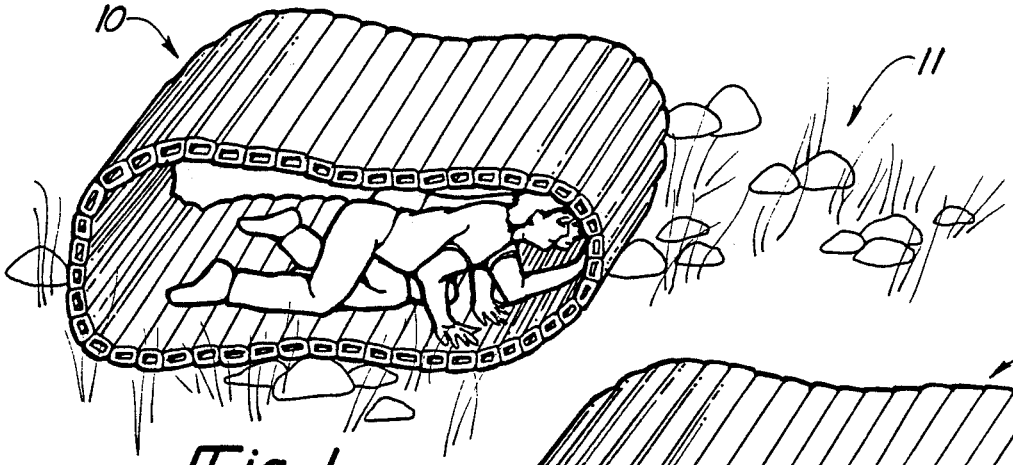
FIG. 1 is a side, elevation perspective view of a first embodiment toy tank made in accordance with the principles of the invention, and showing the toy tank being moved over a ground surface having rocks protruding therefrom.
Figure 2:
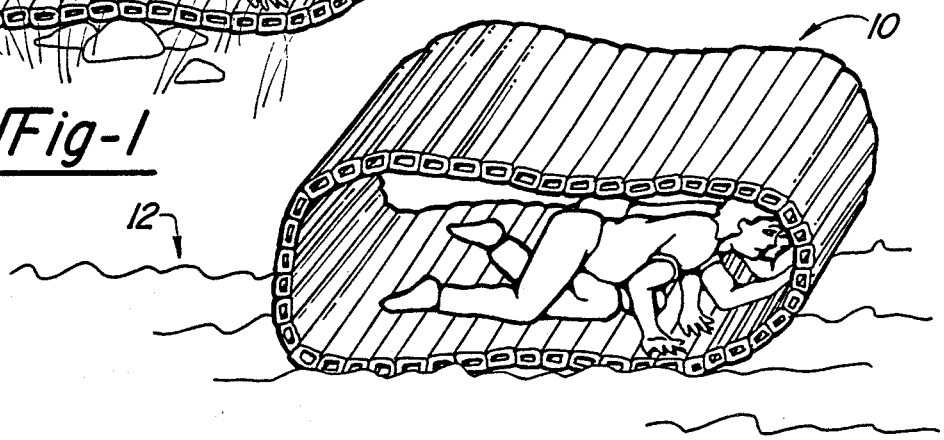
FIG. 2 is a side, elevation perspective view, similar to FIG. 1, of the toy tank of FIG. 1 being moved over water.

Referring now to the drawings, and in particular to FIG. 1, the numeral 10 generally designates a rollable toy tank made in accordance with the principles of the invention, and showing the tank being moved over a ground surface 11 which has a plurality of rocks protruding upward therefrom FIG. 2 shows the rollable toy tank 10 disposed on a different supporting medium namely, a water surface 12, such as the surface of a lake.

Figure 3:
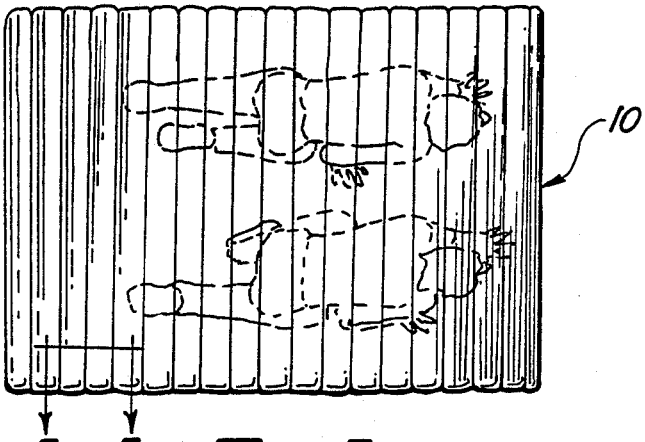
FIG. 3 is a top plan view of the toy tank of FIGS. 1 and 2, and showing that this first embodiment is wide enough for use by two children.

FIG. 3 is top plan view of the tank illustrated in FIGS. 1 and 2, and showing that this first embodiment is wide enough for use by two children crawling therein, to exert a propulsive force on the inside of the tank, to move it over a supporting medium such as a ground surface or a water surface.

Figure 4:
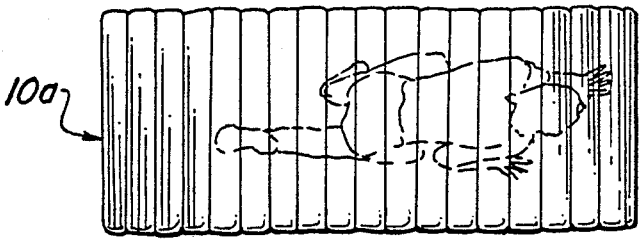
FIG. 4 is a top plan view of a second embodiment toy tank, made to a narrow width, for use by a single child.

FIG. 4 is a top plan view of a second embodiment of the invention and showing a toy tank **10*a*** made to a narrow width so that it is adapted to be used by a single child.

Figure 5:
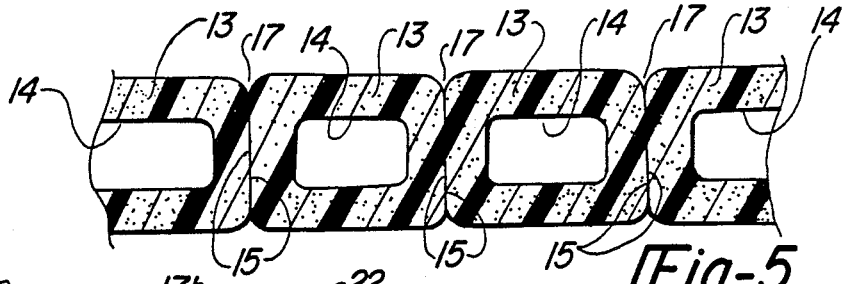
FIG. 5 is a fragmentary, enlarged section view of the toy tank structure shown in FIG. 3, taken along the line 5—5 thereof, and looking in the direction of the arrows.
Figure 7:
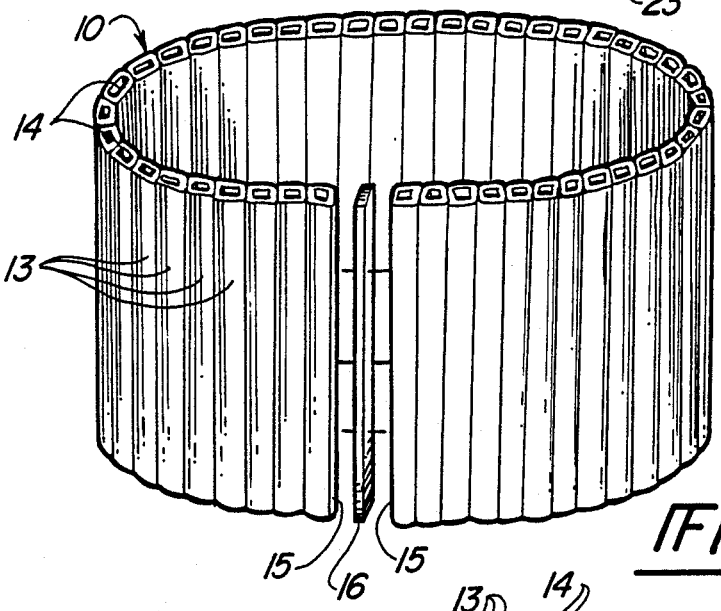
FIG. 7 is an elevation, perspective view of a toy tank, and showing the final assembly step in the making of the toy tanks shown in FIGS. 1–4.
Figure 8:
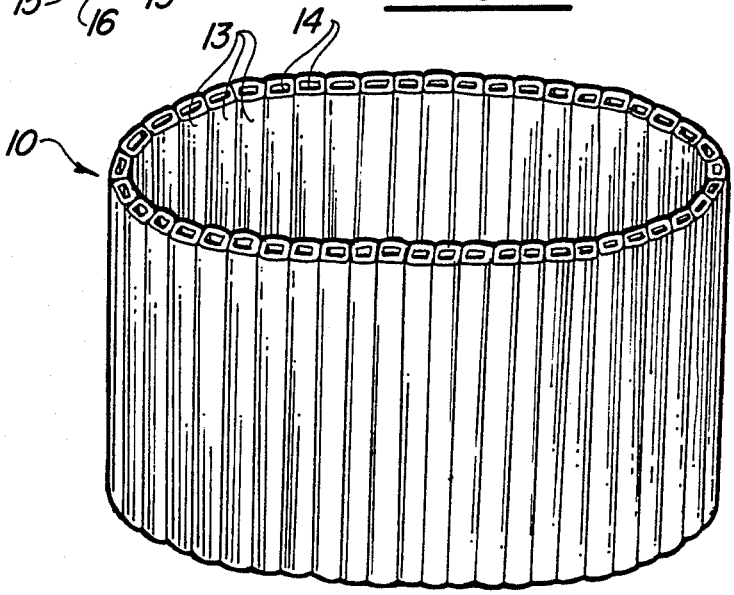
FIG. 8 is an elevation, perspective view of the toy tank of FIG. 7, and showing the toy tank in an assembled condition and ready for use.

The construction and assembly of the toy tank embodiments shown in FIGS. 1–4, is illustrated in FIGS. 5 and 7. As shown in FIG. 7, the toy tank 10 is formed from a plurality of elongated, hollow members 13 which are disposed in a side-by-side relationship to form a closed loop-shaped band, and with the adjacent members 13 being fixed together by any suitable means. As shown in FIG. 5, each of the elongated hollow members 13 is formed with a tubular chamber 14 that extends completely through the elongated members 13. The adjacent side surfaces 15 of the elongated members 13 are fixedly secured to each other by any suitable means, as by a suitable adhesive. Any suitable number of elongated members 13 may be employed. The end elongated members 13 are secured together as illustrated in FIG. 7, by a double backed adhesive tape 16.

As illustrated in FIG. 5, the elongated tubular members 13 are each formed from a suitable thermal foam plastic material which is waterproof and buoyant.

Figure 6:
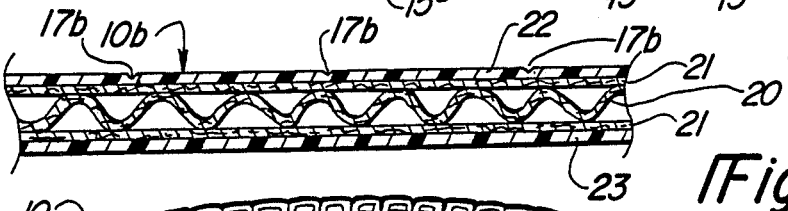
FIG. 6 is an elevation section view of a third embodiment toy tank, and showing a corrugated material for use in fabricating the toy tanks of FIGS. 1–4.

FIG. 6 shows a buoyant, corrugated material for use in fabricating a toy tank in accordance with the invention. The corrugated material may be made from any suitable material, as from cardboard or plastic. In FIG. 6 the numeral 20 indicates the interior corrugations which are enclosed by outer sheets of similar material indicated by the numeral 21. The numerals 22 and 23 designate outer and inner protective coatings, respectively, which may be made from any suitable material, as for example, a suitable flexible plastic material.

As shown in FIGS. 1–4, 5 and 7, the outer surface of the toy tank 10 includes transverse tread means which are formed by indentations 17, along the meeting line 15 between each of the elongated members 13. Similar indentations **17*b* are formed in the outer surface 22 of the embodiment 10*b*, shown in FIG. 6, so as to provide the outer surface of a toy tank provided with the structure of FIG. 6** with transverse tread means.

In one embodiment the elongated members 13 were approximately 1¾ inches in side-to-side width and about 1½ inches thick, with the walls thereof being approximately ⅝ of an inch thick. The thermal foam plastic material employed in the embodiment of FIGS. 1–4 is adapted to provide a buoyancy force, when the toy tank 10 is on a water surface, of about 54 pounds per square inch. The corrugated structure illustrated in FIG. 6 also would be made to about a thickness of approximately 1½ inches.

Figure 9:
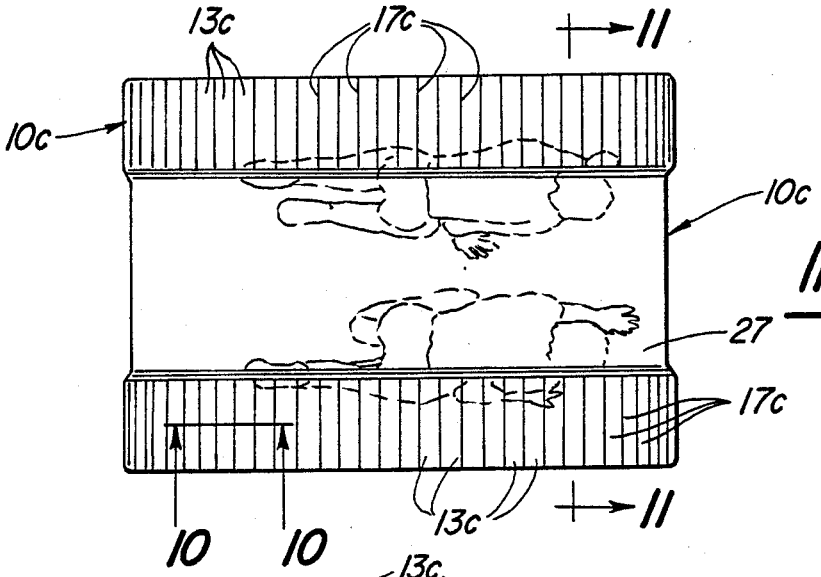
FIG. 9 is a top plan view of a fourth embodiment toy tank made in accordance with the principles of the invention.
Figure 10:
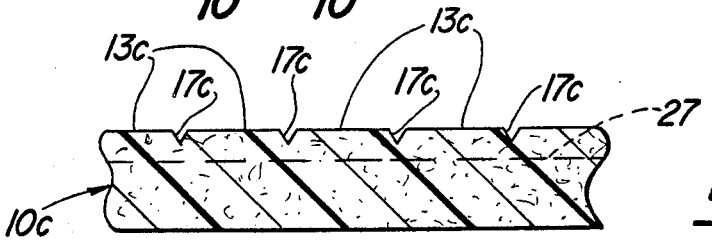
FIG. 10 is a fragmentary, longitudinal, enlarged elevation section view of the toy tank structure shown in FIG. 9, taken along the line 10—10 thereof, and looking in the direction of the arrows.

FIG. 9 is a top view of a fourth embodiment toy tank **10*c* which is made from a single sheet of solid, buoyant, thermal foam plastic that is folded into a closed loop-shaped band, with the ends of the sheet fixed together by any suitable adhesive. FIG. 10 shows a fragmentary, longitudinal cross section of the solid thermal foam plastic tubular body of this fourth embodiment. The toy tank 10*c* has a plurality of raised transverse treads or ribs 13*c* along each of the outer side portions of the outer surface of the tubular body, with the depressed or lower center portion 27 of said outer surface being smooth and available for any desired markings, such as camouflage markings. The treads 13*c* are separated by indentations 17*c***.

Figure 11:
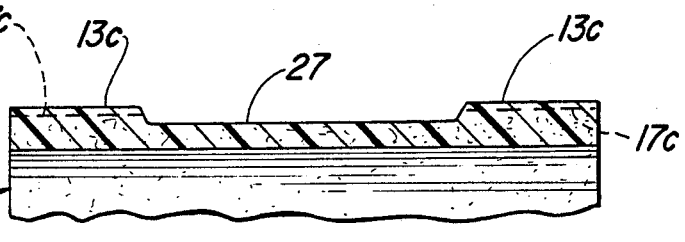
FIG. 11 is a fragmentary, transverse, enlarged elevation section view of the toy tank structure shown in FIG. 9, taken along the line 11—11 thereof, and looking in the direction of the arrows.

FIG. 11 is a fragmentary, transverse elevation section view of the toy tank structure shown in FIG. 9, and showing the center outer surface 27 as being depressed or lower than the outwarding extending treads **13*c***.

Figure 12:
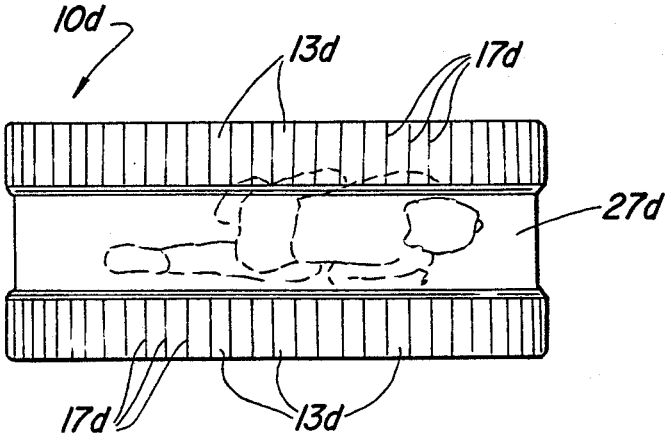
FIG. 12 is a top plan view of a fifth embodiment toy tank made in accordance with the principles of the invention.

FIG. 12 is a top view of a single child toy tank **10*d* made from a solid, buoyant, thermal foam plastic, and provided with raised transverse treads or ribs 13*c* separated by indentations 17*c*, and provided with a smooth depressed center surface 27*d***.

In use, the toy tank of the present invention is adapted to be rolled forward on a supporting ground or water surface, by a combination forward and downward directed force exerted on the internal surface of one end of the tubular body, by the normal crawling action of at least one person inside of the tubular body so that the tubular body rotates around the crawling person. The toy tank of the invention is floatable, so as to carry a person crawling therein if the toy tank should be rolled over a water surface. The toy tank can also be used in snow, and it can slide like a toboggan. It can also be used in rainy weather and over a ground surface having obstacles thereon, such as rocks and logs.

What is claimed is:

1. A rollable toy tank comprising:

(a) a flexible, tubular body adapted to be rollably disposed on a supporting medium;

(b) said flexible tubular body comprising a closed loop-shaped band which is open at the transverse sides thereof;

(c) said toy tank being adapted to be rolled forward on said supporting medium by a combination forward and downward directed force exerted on the internal surface of one end of the tubular body by the forward crawling action of at least one person inside of the tubular body;

(d) the outer surface of the tubular body is provided with transverse tread means;

(e) said tubular body is formed from a plurality of elongated, hollow members which are disposed in a side-by-side relationship to form a closed loop, and with adjacent members being fixed together; and, (f) said elongated, hollow members are formed from a thermal foam plastic material.

* * * * *